US009696103B2

(12) United States Patent
Bender

(10) Patent No.: US 9,696,103 B2
(45) Date of Patent: Jul. 4, 2017

(54) TRIGGER WITH CAM

(71) Applicant: Terrence Dwight Bender, Minneapolis, MN (US)

(72) Inventor: Terrence Dwight Bender, Minneapolis, MN (US)

(73) Assignee: In Ovation LLC, Minneapolis, MN (US)

( * ) Notice: Subject to any disclaimer, the term of this patent is extended or adjusted under 35 U.S.C. 154(b) by 0 days.

(21) Appl. No.: 14/930,776

(22) Filed: Nov. 3, 2015

(65) Prior Publication Data

US 2016/0054084 A1 Feb. 25, 2016

Related U.S. Application Data

(63) Continuation of application No. 14/226,576, filed on Mar. 26, 2014, now Pat. No. 9,175,917.

(60) Provisional application No. 61/963,410, filed on Dec. 3, 2013.

(51) Int. Cl.

| | |
|---|---|
| ***F41A 19/47*** | (2006.01) |
| ***F41A 19/10*** | (2006.01) |
| ***F41A 19/14*** | (2006.01) |
| ***F41A 19/43*** | (2006.01) |

(52) U.S. Cl.

CPC ..... *F41A 19/10* (2013.01); *F41A 19/14* (2013.01); *F41A 19/43* (2013.01); *F41A 19/47* (2013.01)

(58) Field of Classification Search

CPC ..... F41A 19/14; F41A 19/44; F41A 19/47; F41A 19/48

See application file for complete search history.

(56) References Cited

U.S. PATENT DOCUMENTS

| | | | | |
|---|---|---|---|---|
| 2,703,943 | A * | 3/1955 | Roemer | F41A 19/42 42/66 |
| 2,920,413 | A | 1/1960 | Marhefka et al. | |
| 3,206,884 | A | 9/1965 | Purvis | |
| 3,768,190 | A | 10/1973 | Ruger et al. | |
| 4,005,540 | A | 2/1977 | Robinson | |
| 4,310,981 | A | 1/1982 | Waddell | |
| 4,667,429 | A | 5/1987 | Perazzi | |
| 4,680,884 | A | 7/1987 | Smith, Jr. et al. | |
| 4,691,461 | A | 9/1987 | Behlert | |
| 4,955,155 | A | 9/1990 | Jones | |
| 5,018,292 | A | 5/1991 | West | |
| 5,463,829 | A | 11/1995 | Sprangers | |

(Continued)

FOREIGN PATENT DOCUMENTS

DE 102007004588 * 7/2008

OTHER PUBLICATIONS

U.S. Appl. No. 61/461,434, filed Jan. 18, 2011; Inventor: Terrence D. Bender.

(Continued)

*Primary Examiner* — Stephen M Johnson

(74) *Attorney, Agent, or Firm* — Vidas, Arrett & Steinkraus

(57) ABSTRACT

In some embodiments, a trigger group comprises a trigger arranged to pivot on a trigger axis and a hammer arranged to pivot on a hammer axis. The hammer includes a cam surface. The hammer is moveable from a first position to a second position upon break of the trigger, and the cam surface contacts the trigger in the second position. Desirably, the cam is arranged to bias the trigger.

18 Claims, 10 Drawing Sheets

(56) References Cited

U.S. PATENT DOCUMENTS

| | | | | |
|---|---|---|---|---|
| 5,548,914 | A * | 8/1996 | Anderson | F41A 19/52 42/65 |
| 5,623,114 | A | 4/1997 | Soper | |
| 5,881,485 | A | 3/1999 | Milazzo | |
| 5,904,132 | A | 5/1999 | Biller | |
| 6,164,001 | A | 12/2000 | Lee | |
| 6,298,594 | B1 | 10/2001 | Strayer | |
| 6,367,465 | B1 | 4/2002 | Buccieri, Jr. | |
| 6,615,527 | B1 | 9/2003 | Martin | |
| 6,651,642 | B1 | 11/2003 | Powers | |
| 6,722,072 | B1 | 4/2004 | McCormick | |
| 7,162,824 | B1 | 1/2007 | McCormick | |
| 7,188,561 | B1 | 3/2007 | Kelbly | |
| 7,293,385 | B2 | 11/2007 | McCormick | |
| 7,331,136 | B2 | 2/2008 | Geissele | |
| 7,600,338 | B2 | 10/2009 | Geissele | |
| 7,661,220 | B2 | 2/2010 | Crandall et al. | |
| 7,854,084 | B1 | 12/2010 | Rutherford | |
| 7,992,338 | B2 | 8/2011 | Bowman et al. | |
| 8,893,607 | B2 | 11/2014 | Audibert et al. | |
| 2006/0207149 | A1 | 9/2006 | Lazor | |
| 2008/0010889 | A1 | 1/2008 | Metzger et al. | |
| 2009/0183414 | A1 | 7/2009 | Geissele | |
| 2009/0266348 | A1 | 10/2009 | Yeh | |
| 2010/0281739 | A1 | 11/2010 | Geissele | |
| 2012/0117841 | A1 | 5/2012 | Joubert et al. | |
| 2013/0167423 | A1 | 7/2013 | Lupher et al. | |

OTHER PUBLICATIONS

U.S. Appl. No. 61/462,263, filed Jan. 31, 2011; Inventor: Terrence D. Bender.
U.S. Appl. No. 61/465,241, filed Mar. 16, 2011; Inventor: Terrence D. Bender.
Zediker, Glenn, AR15 Triggers, Zediker Publishing, 2007, pp. 1-3.
http://www.snipershide.com/forum/ubbthreads.php+48 ubb+showthreaded&Number=501733, Jan. 26, 2012.
http://www.compasslake.com/trigger.htm, Jan. 26, 2012.
http://www.jprifles.com/1.4.8.1_ezt.php, Jan. 26, 2012.
http://cmmginc.secure-mall.com/item/CMMG-Two-Stage-Trigger-1504, Jan. 26, 2012.
http://shopwilsoncombat.com/Tactical-Trigger-Unit-Single-Stage-Semi-Auto/productinfo/TR-TTU/?gclid= CP6b79SY8aYCFYQUKgodTRRBBg, Jan. 26, 2012.
http://geissele.com/index.aspx, Jan. 26, 2012.
http://www.midwayusa.com/product/709049/jewell-trigger-assembly-ar-15-small-pin-154-two-stage-matte, Jan. 26, 2012.
http://www.jardinc.com/index.php?option=com_content &view=article&id=12:ar-le&catid=18:ar-15-single-stage &Itemid=6, Jan. 26, 2012.
Schematic drawing, Gun Assy, BFG-50A, Serbu Firearms, Inc., Apr. 25, 2011, p. 1.

* cited by examiner

TRIGGER WITH CAM

CROSS-REFERENCE TO RELATED APPLICATIONS

This application is a continuation of U.S. patent application Ser. No. 14/226,576, filed Mar. 26, 2014, now U.S. Pat. No. 9,175,917, which claims the benefit of U.S. Patent Application No. 61/963,410, filed Dec. 3, 2013, the entire content of which is hereby incorporated herein by reference.

BACKGROUND OF THE INVENTION

This invention relates to triggers and firearm trigger groups.

Firearms and triggers are known in the art. A trigger will have a given pull weight and trigger feel during firing. In some cases, a better trigger feel is desired.

Some trigger designs have employed lighter weight hammer and trigger springs to reduce trigger pull weight compared to a stock design, or added more springs to further reduce trigger weight. However, reducing trigger pull weight alone does not necessarily change the way the trigger feels to a shooter at firing.

Much of the shooter's perceived trigger feel stems from a drop in trigger pull weight at trigger "break," or release of the hammer. For example, the optimal pull weight specified to cause trigger break in a stock M16/AR15 is 5.5 pounds. Immediately after the hammer is released by the trigger, the contribution to trigger weight that the shooter feels is from the trigger spring alone, or approximately 1.5 pounds. Thus, a shooter will feel a change/reduction in weight of the trigger during pull at and after break of approximately 4.0 pounds. In some low weight trigger groups, if the maximum pull weight has been reduced to 2.5 pounds, then the change/reduction in perceived trigger weight after hammer release is only 1.0 pound. This change in weight is very small, and the tactile feedback perceived by the shooter can become too subtle to indicate hammer fall before the firearm's audible signal that the cartridge was fired.

There remains a need for novel trigger designs that provide for a better feel at break. There remains a need for trigger designs that provide a more positive tactile indication of break to a shooter's trigger finger.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a trigger group comprises a trigger arranged to pivot on a trigger axis and a hammer arranged to pivot on a hammer axis. The hammer includes a cam surface. The hammer is moveable from a first position to a second position upon break of the trigger, and the cam surface contacts the trigger in the second position. Desirably, the cam is arranged to bias the trigger.

In some embodiments, the cam surface is formed by a process of machining, wherein material is removed from the hammer In some embodiments, the hammer comprising a secondary contact point in contact with the trigger when the hammer is in the first position. The secondary contact point sets a predetermined amount of trigger creep to break.

In some embodiments, a trigger group comprises a trigger arranged to pivot on a trigger axis and a hammer arranged to pivot on a hammer axis. The trigger is biased in a first rotational direction by a trigger spring. The hammer is biased in a second rotational direction by a hammer spring. The trigger comprises a trigger sear and a following portion. The hammer comprises a hammer sear and a surface adjacent to said sear, the surface comprising a cam. The hammer is moveable from a first position wherein the trigger sear contacts said hammer sear to a second position wherein the cam surface contacts the following surface.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
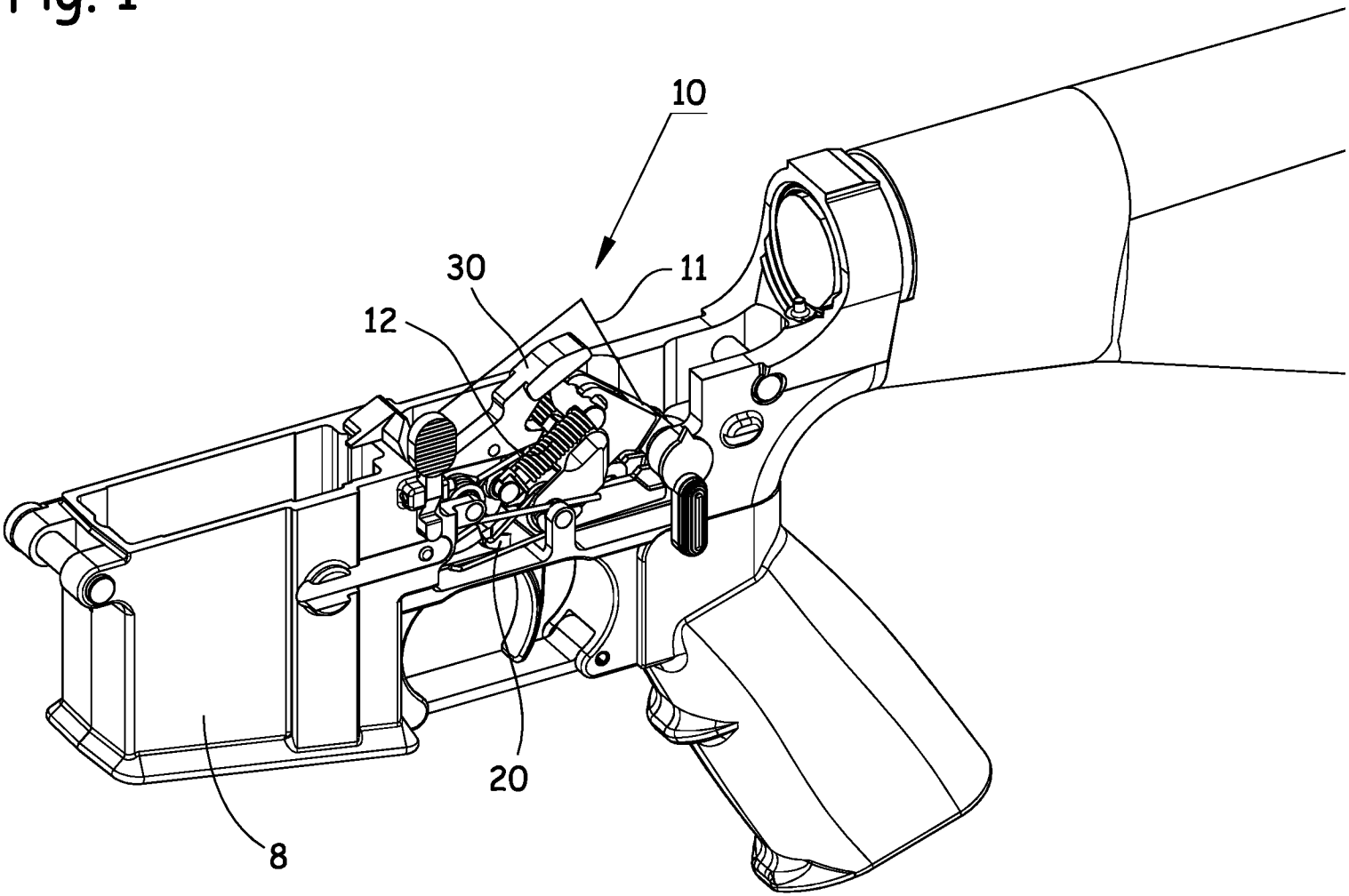
FIG. 1 shows an embodiment of a trigger group in a housing.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a trigger group 10 installed in a housing 8, such as an AR lower receiver. A portion of the housing 8 has been cut away to show components of the trigger group 10.

The trigger group 10 comprises a trigger 20 and a hammer 30. In some embodiments, the trigger group 10 comprises a secondary spring system 12, for example as disclosed in U.S. Pat. No. 8,572,880, the entire disclosure of which is hereby incorporated herein by reference.

Figure 2:
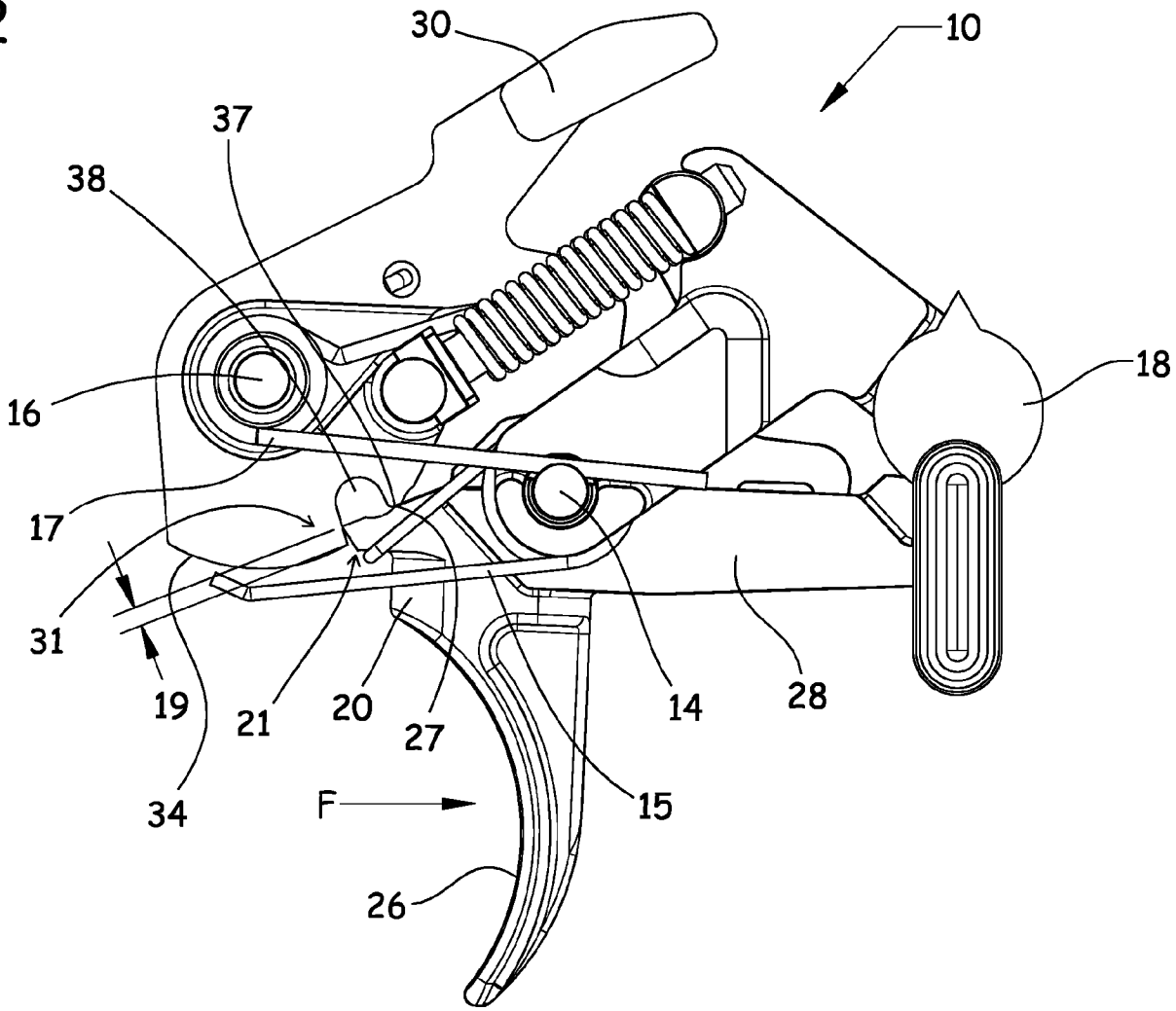
FIG. 2 shows an embodiment of a trigger group in a first orientation.
Figure 3:
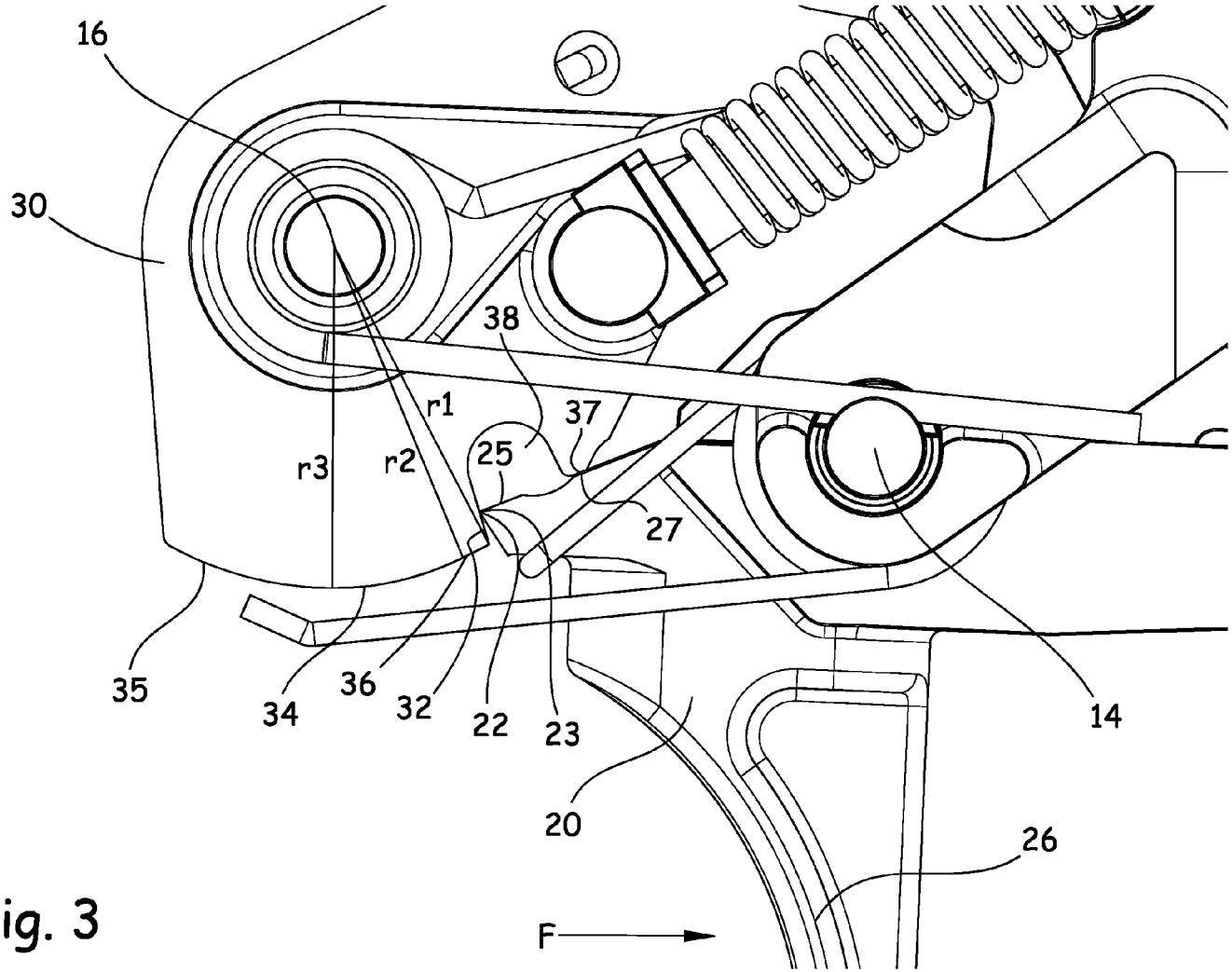
FIG. 3 shows a portion of FIG. 2 in greater detail.
Figure 4:
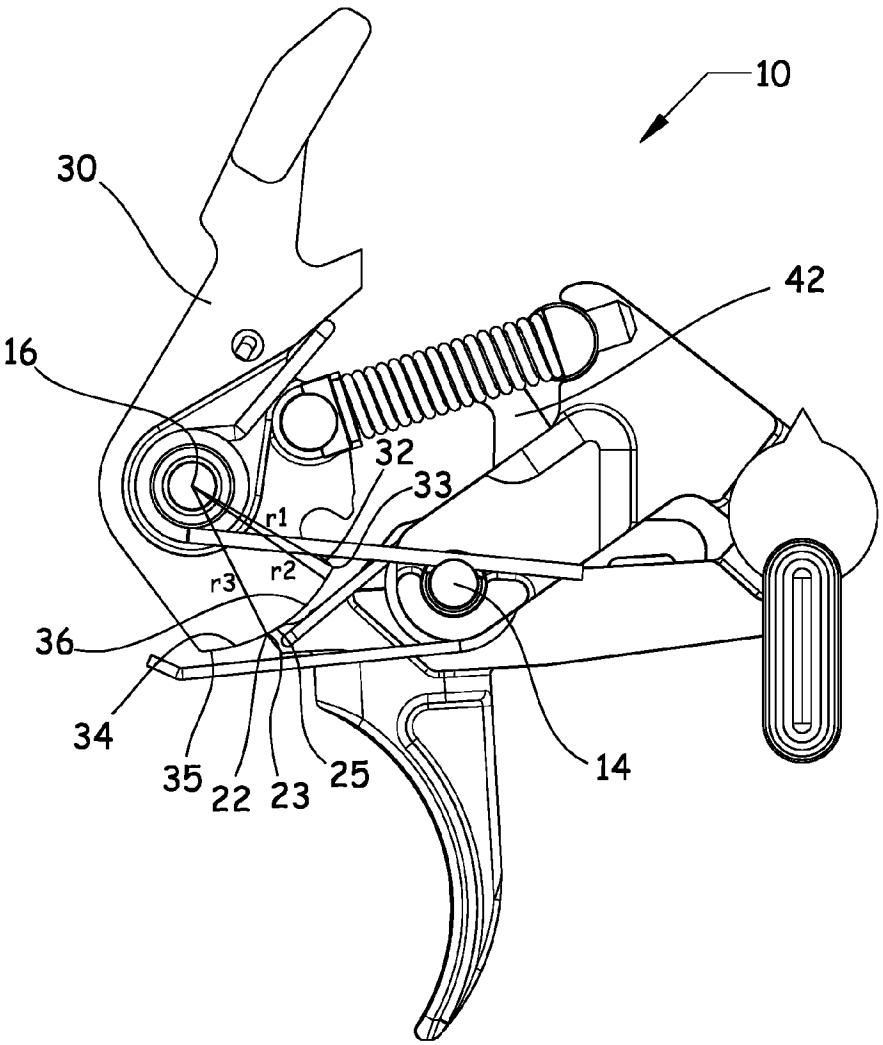
FIG. 4 shows an embodiment of a trigger group in a second orientation.

FIGS. 2-4 show the trigger group 10 of FIG. 1 in greater detail. FIG. 2 shows the trigger group 10 in a first orientation, wherein the trigger group 10 is cocked. FIG. 3 shows a portion of FIG. 2 in greater detail. FIG. 4 shows the trigger group 10 in a second orientation, after trigger break, as the hammer 30 is falling.

In some embodiments, the trigger 20 comprises a finger trigger 26 and a safety interface portion 28 that contacts a safety mechanism 18. Desirably, the trigger 20 comprises a hammer engaging portion 21 arranged to interface with the hammer 30. In some embodiments, the trigger 20 is arranged to rotate about a trigger axis 14, and is biased in a first rotational direction (e.g. clockwise) by a trigger spring 15. A force F applied to the trigger 20 by a shooter's finger will generally bias the trigger 20 in a second rotational direction (e.g. counter-clockwise), opposite that of the trigger spring 15.

In some embodiments, the hammer 30 is arranged to rotate about a hammer axis 16, and is biased in a second rotational direction (e.g. counter-clockwise) by a hammer spring 17. Desirably, the hammer 30 comprises a trigger engaging portion 31 arranged to interface with the trigger 20.

FIG. 3 shows portions of the hammer 30 and trigger 20 in greater detail. Desirably, the hammer 30 comprises a hammer sear 32 and the trigger 20 comprises a trigger sear 22. In the first orientation of the trigger group 10, illustrated in FIGS. 2 and 3, the trigger 20 contacts the hammer 30 and interferes with rotation of the hammer 30. Desirably, the trigger sear 22 contacts the hammer sear 32, and contact between the sears 22, 32 prevents the hammer 30 from "falling."

As a shooter's finger applies a force F to the trigger 20, the trigger is rotated in the second rotational direction (e.g. counter-clockwise), causing the trigger sear 22 to slide against the hammer sear 32. This sliding engagement between the sears 22, 32 is generally referred to as "creep." When the trigger 20 has rotated enough that the trigger sear 22 clears the hammer sear 32, the hammer 30 falls—this is generally referred to as "break."

Desirably, the trigger group 10 comprises a cam surface arranged to bias the trigger 20 in the second rotational direction (e.g. counter-clockwise) after trigger break, as the hammer 30 falls. In some embodiments, the hammer 30 comprises surface 34 located adjacent to the hammer sear 32, and at least a portion of the surface 34 comprises a cam surface 36. In some embodiments, the trigger 20 comprises a following portion 25. As the hammer 30 rotates, the cam surface 36 contacts the following portion 25 of the trigger 20 and applies a force to the following portion 25 that acts to bias the trigger 20 in the second rotational direction (e.g. counter-clockwise). A following portion 25 can have any suitable shape or configuration. In some embodiments, a following portion 25 comprises an edge portion of the trigger 20 located adjacent the trigger sear 22. In some embodiments, a following portion 25 comprises a surface having an area. In some embodiments, a following portion 25 simply comprises the portion of the trigger 20 that contacts the cam surface 36.

FIG. 4 shows the trigger group 10 of FIGS. 2 and 3 in a second orientation, after trigger break, as the hammer 30 is falling. The cam surface 36 of the hammer 30 is in contact with the following portion 25 of the trigger 20. A variation in radial dimension of the cam surface 36 has caused the trigger 20 to be moved by the cam surface 36 as the hammer 30 moves falls from break to the orientation shown in FIG. 4. Desirably, a radial dimension of the cam surface 36 (e.g. as measured from the hammer axis 16 to the point of contact with the following portion 25) increases as the cam surface 36 is traversed in a direction away from the hammer sear 32 along a length of the cam surface 36. For example, FIGS. 3 and 4 show radial lines $r_1$, $r_2$ and $r_3$. Radial line $r_1$ extends to a start of the cam surface 36 and radial lines $r_2$ and $r_3$ extend to locations along the length of the cam surface 36. Desirably, a length of a first radial line $r_1$ is less than a length of a second radial line $r_2$. Desirably, a length of a second radial line $r_2$ is less than a length of a third radial line $r_3$.

The force applied to the trigger 20 by the cam surface 36 changes the feel of the trigger group 10 to the shooter subsequent to trigger break. Without a cam surface 36, the shooter's finger continually feels the force of the trigger spring 15 biasing the trigger 20 in a direction opposite to the force F applied by the shooter. When a cam surface 36 is used, the force applied to the trigger 20 by the cam surface 36 works to temporarily unload or reduce the load applied to the shooter's finger as the hammer 30 falls, which greatly changes the perceived feel of the trigger to the shooter.

The cam surface 36 can provide any suitable amount of change in radial dimension along its length. In practice, only a small amount of dimensional change is necessary to cause a change in the perceived feel of the trigger 20 after break. In some embodiments, the change in radial dimension may not be visible to the naked eye.

With respect to the radial lines $r_1$, $r_2$ and $r_3$ shown in FIGS. 3 and 4, in some embodiments, the first radial line $r_1$ is approximately 8 degrees of rotation away from the second radial line $r_2$. In some embodiments, second radial line $r_2$ is approximately 0.003 inches longer than the first radial line $r_1$. In some embodiments, the second radial line $r_2$ is approximately 27 degrees of rotation away from the third radial line $r_3$. In some embodiments, third radial line $r_3$ is approximately 0.006 inches longer than the second radial line $r_2$. In some embodiments, the first radial line $r_1$ is approximately 35 degrees of rotation away from the third radial line $r_3$. In some embodiments, third radial line $r_3$ is approximately 0.009 inches longer than the first radial line $r_1$.

The cam surface 36 can be located any suitable distance from the hammer axis 16. In some embodiments, the first radial line $r_1$ has a length of approximately 0.524 inches. In some embodiments, the second radial line $r_2$ has a length of approximately 0.527 inches. In some embodiments, the third radial line $r_3$ has a length of approximately 0.533 inches.

In some embodiments, the cam surface 36 extends beyond the location of the third radial line $r_3$. In some embodiments, the cam surface 36 terminates at the third radial line $r_3$ and the surface 34 transitions to a non-camming portion 35 (e.g. of constant radius).

It is also possible to have the lower surface of the hammer 30 begin with a non-camming surface that becomes a cam surface 36. Such an embodiment can provide a slight delay in trigger force unloading after break, providing a different trigger feel that may be desired by some shooters.

The cam surface 36 can have any suitable amount of curvature. An increase in radial dimension of the cam surface 36 with respect to change in rotation can be linear, non-linear, logarithmic, exponential, etc. A change in radial dimension of the cam surface 36 per degree of rotation can be continually increasing, constant, continually decreasing, etc.

In some embodiments, a radial dimension from the hammer axis 16 to the surface 34 only increases as the surface 34 is traversed in a direction away from the hammer sear 32. For example, the first radial line $r_1$ can represent the lowest radial dimension for the surface 34. In some embodiments, the surface 34 comprises a first cam surface 36 and a second cam surface 36 separated by a non-camming portion 35.

In some embodiments, the cam surface 36 comprises a machined surface. Desirably, a machined surface is a surface that is not merely cast-in-place. For example, a machined surface can be formed by removing material from a precursor surface using any suitable method, such as a cutting tool, grinding, etching, electrical discharge machining, etc.

In some embodiments, the hammer sear 32 and the cam surface 36 share a common edge 33. In some embodiments, the common edge 33 comprises a transition from sear surface 32 to cam surface 36. In some embodiments, the common edge 33 comprises a machined surface. In some embodiments, the common edge 33 is machined to a very small radius, for example a radius of approximately 0.0003 inches.

In some embodiments, the trigger group 10 includes a secondary engagement region between the trigger 20 and hammer 30 that sets the amount of creep necessary between a first orientation (e.g. cocked) and trigger break. As shown in FIGS. 2 and 3, in some embodiments, the hammer 30 comprises a secondary contact point 37 that contacts a secondary contact location 27 of the trigger 20 in the first orientation (e.g. cocked). This secondary contact 27, 37 interaction sets the rotational orientation of the hammer 30 and the trigger 20, and arranges the hammer sear 32 and trigger sear 22 in a repeatable predetermined orientation, specifically as illustrated in FIGS. 2 and 3. This repeatable predetermined orientation sets the amount of creep 19 (see FIG. 2) between the first orientation and trigger break, or clearance of the sears 32, 22.

In some embodiments, a radial dimension from the hammer axis 16 to the hammer secondary contact location 37 is less than a radial dimension from the hammer axis 16 to the cam surface 36. In some embodiments, the hammer 30 comprises a notch 38 located between the hammer sear 32 and the hammer secondary contact location 37. In some embodiments, a radial dimension from the trigger axis 14 to the trigger secondary contact location 27 is less than a radial dimension from the trigger axis 14 to the trigger sear 22. In some embodiments, the trigger secondary contact location 27 and the following portion 25 comprise a common surface. In some embodiments, the trigger secondary contact location 27 is located between the trigger axis 14 and the trigger sear 22. In some embodiments, the trigger 20 comprises a notch located between the trigger sear 22 and the trigger secondary contact location 27.

In some embodiments, the trigger sear 22 and the following portion 25 are aligned on a plane 11 (see FIG. 1) oriented orthogonal to the trigger axis 14, wherein the plane 11 intersects a portion of the trigger sear 22 and a portion of the following portion 25. In some embodiments, the trigger secondary contact location 27 is also aligned on the plane 11.

In some embodiments, the hammer sear 32 and the cam surface 36 are aligned on a plane 11 (see FIG. 1) oriented orthogonal to the hammer axis 16, wherein the plane 11 intersects a portion of the hammer sear 32 and a portion of the cam surface 36. In some embodiments, the hammer secondary contact location 37 is also aligned on the plane 11.

In some embodiments, the trigger sear 22, following portion 25, trigger secondary contact location 27, hammer sear 32, cam surface 36 and hammer secondary contact location 37 are all aligned on the plane 11.

Figure 6:
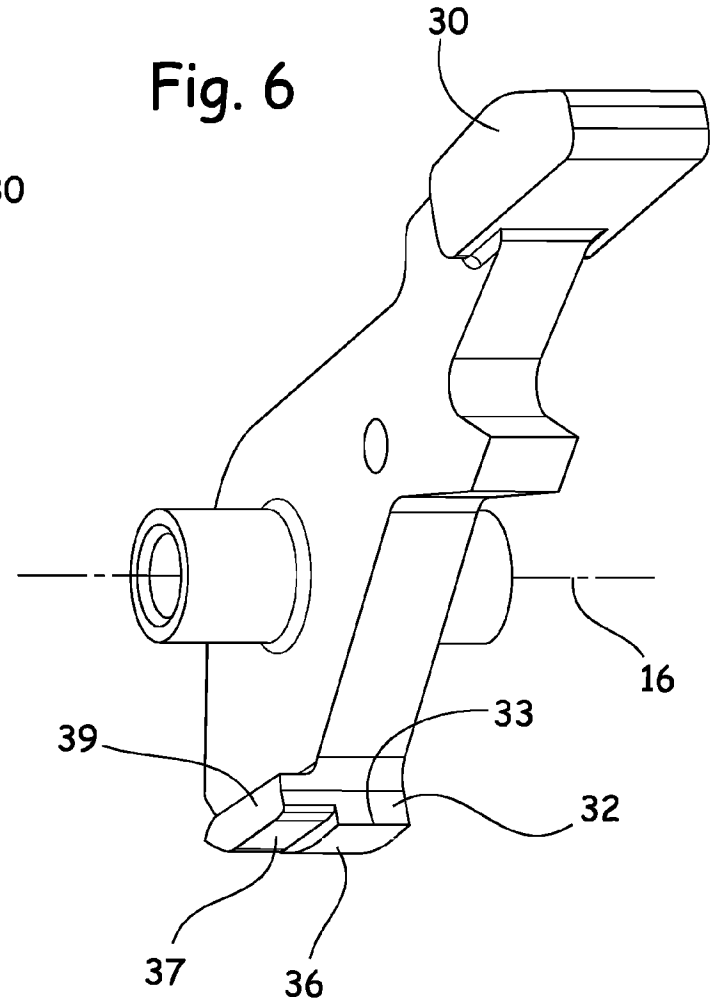
FIGS. 5 and 6 show different views of an embodiment of a hammer.
Figure 5:
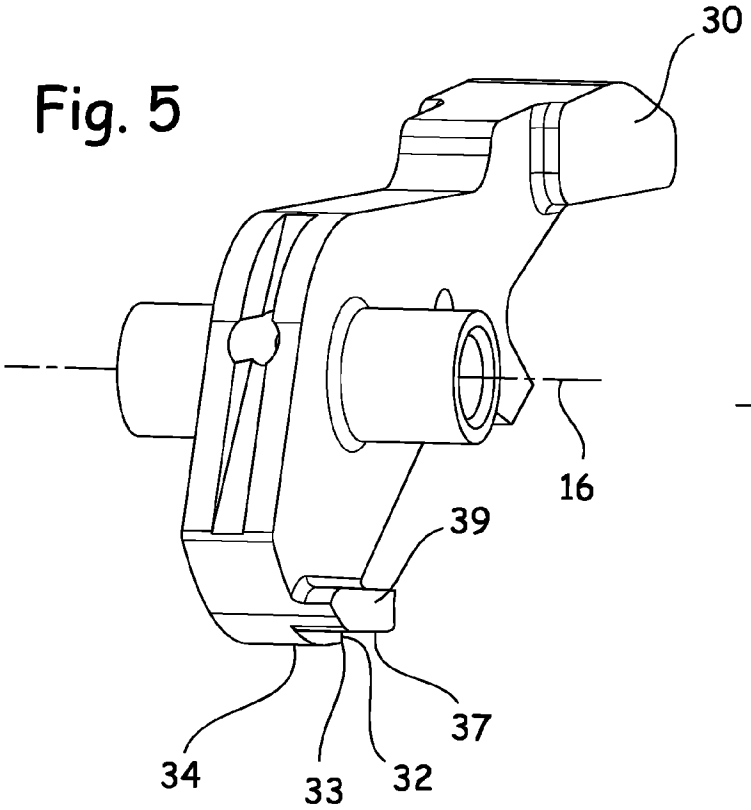

FIGS. 5 and 6 show views of another embodiment of a hammer 30. In some embodiments, a hammer 30 comprises a hammer sear 32 and a cam surface 36. The cam surface 36 comprises a cam with respect to the hammer axis 16. In some embodiments, the hammer sear 32 and cam surface share a common edge 33.

In some embodiments, a hammer 30 comprises a hammer secondary contact location 37. In some embodiments, at least a portion of the hammer secondary contact location 37 comprises a lobe 39 that extends from the hammer 30 in a lateral direction.

In some embodiments, the hammer secondary contact location 37 is located adjacent the cam surface 36. In some embodiments, the cam surface 36 occupies a first width portion of the hammer 30 and the hammer secondary contact location 37 occupies a second width portion of the hammer 30. Desirably, a width portion is measured in a direction parallel to the hammer axis 16. In some embodiments, the hammer secondary contact location 37 is located adjacent the hammer sear 32. In some embodiments, the hammer sear 32 occupies a first width portion of the hammer 30 and the hammer secondary contact location 37 occupies a second width portion of the hammer 30. In some embodiments, a plane 11 (see FIG. 1) will intersect a portion of the hammer sear 32 but will not intersect a portion of the hammer secondary contact location 37. In some embodiments, a plane 11 will intersect a portion of the cam surface 36 but will not intersect a portion of the hammer secondary contact location 37.

Figure 8:
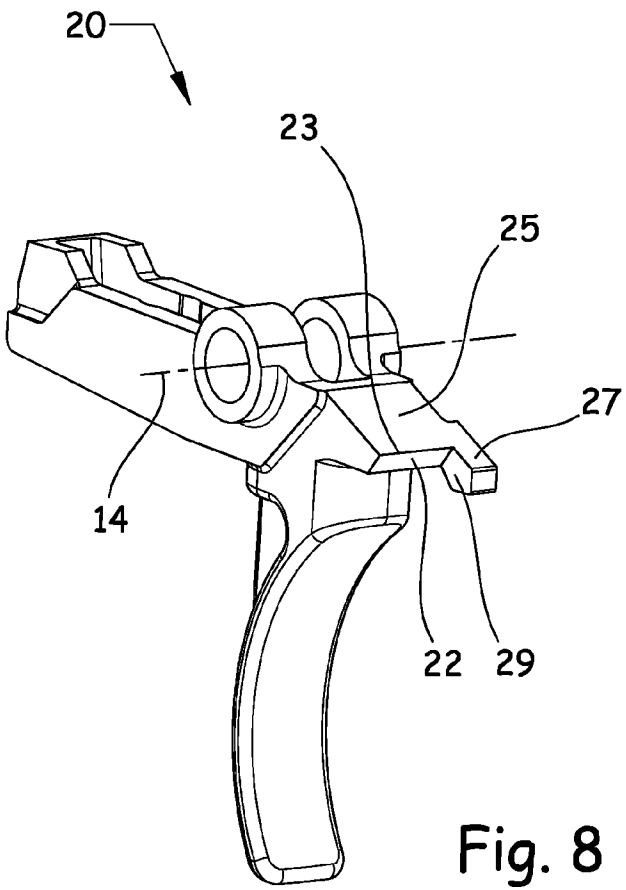
FIGS. 7 and 8 show different views of an embodiment of a trigger.
Figure 7:
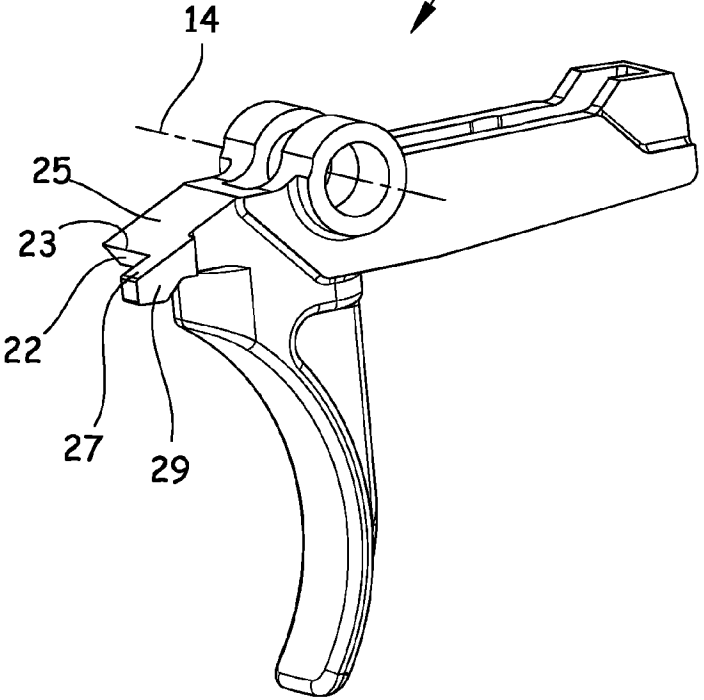

FIGS. 7 and 8 show views of another embodiment of a trigger 20. In some embodiments, a trigger comprises a trigger sear 22 and a following portion 25. In some embodiments, the following portion 25 comprises at least a portion of the common edge 23. In some embodiments, the trigger sear 22 and the following portion 25 share a common edge 23, and the following portion 25 extends from said edge 23 and defines an area.

In some embodiments, a trigger 20 comprises a trigger secondary contact location 27. In some embodiments, at least a portion of the trigger secondary contact location 27 comprises a lobe 29 that extends from the trigger 20 in a lateral direction.

In some embodiments, the trigger secondary contact location 27 is located adjacent the following portion 25. In some embodiments, the following portion 25 occupies a first width portion of the trigger 20 and the trigger secondary contact location 27 occupies a second width portion of the trigger 20. Desirably, a width portion is measured in a direction parallel to the trigger axis 14. In some embodiments, a planar surface comprises both the following portion 25 and the trigger secondary contact location 27. In some embodiments, the trigger secondary contact location 27 is located adjacent the trigger sear 22. In some embodiments, the trigger sear 22 occupies a first width portion of the trigger 20 and the trigger secondary contact location 27 occupies a second width portion of the trigger 20. In some embodiments, a plane 11 (see FIG. 1) will intersect a portion of the trigger sear 22 but will not intersect a portion of the trigger secondary contact location 27. In some embodiments, a plane 11 will intersect a portion of the following portion 25 but will not intersect a portion of the trigger secondary contact location 27.

Figure 9:
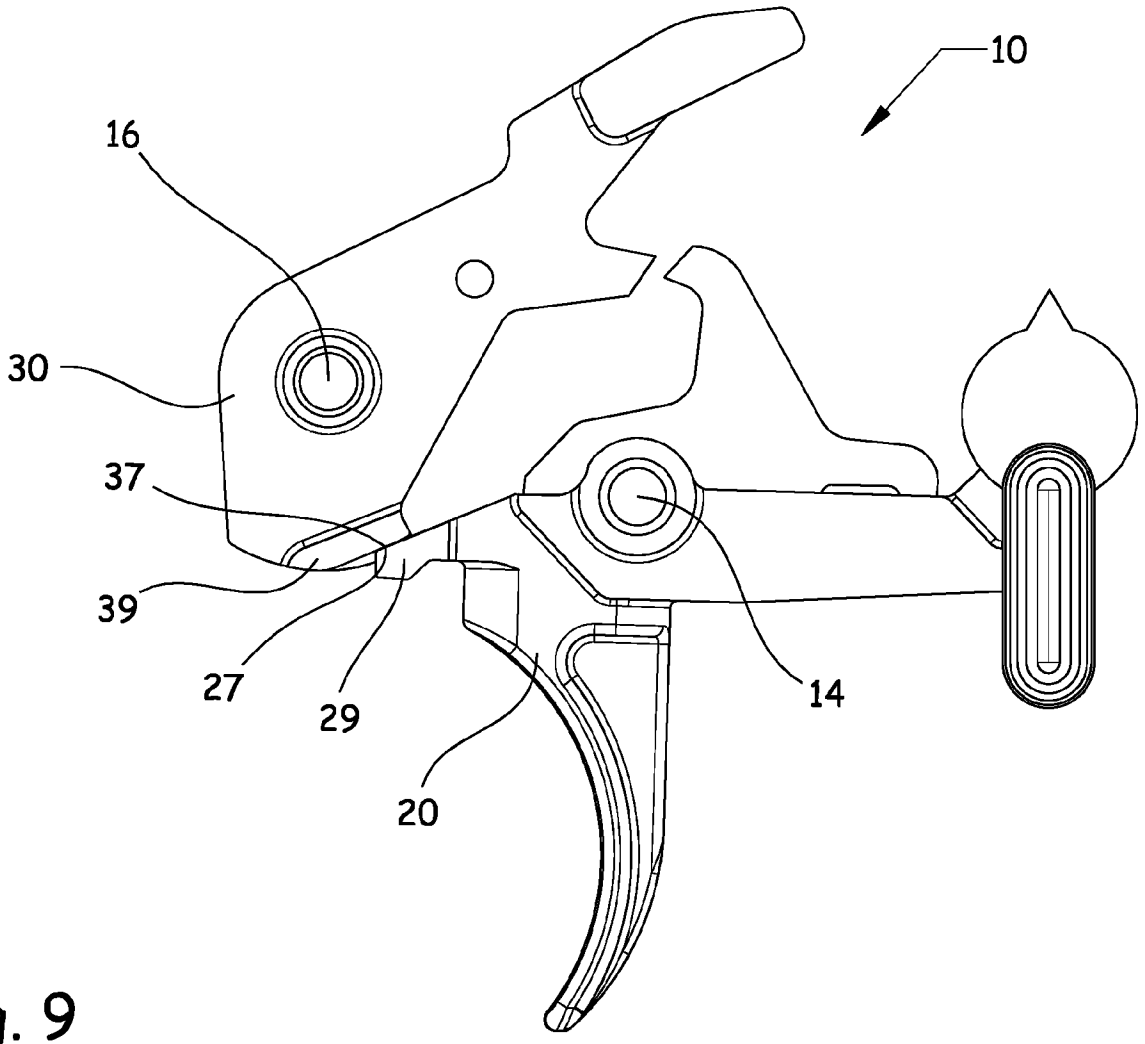
FIG. 9 shows an embodiment of a trigger group having the hammer shown in FIGS. 5 and 6 and the trigger shown in FIGS. 7 and 8, in a first orientation.

FIG. 9 shows an embodiment of a trigger group 10 comprising the hammer 30 illustrated in FIGS. 5 and 6, and the trigger 20 illustrated in FIGS. 7 and 8. The trigger group 10 is shown in a first orientation (e.g. cocked) wherein the hammer sear and trigger sear (not visible in FIG. 9) are engaged with one another. The hammer lobe 39 is arranged to contact the trigger lobe 29 such that the hammer secondary contact location 37 contacts the trigger secondary contact location 27.

Figure 10:
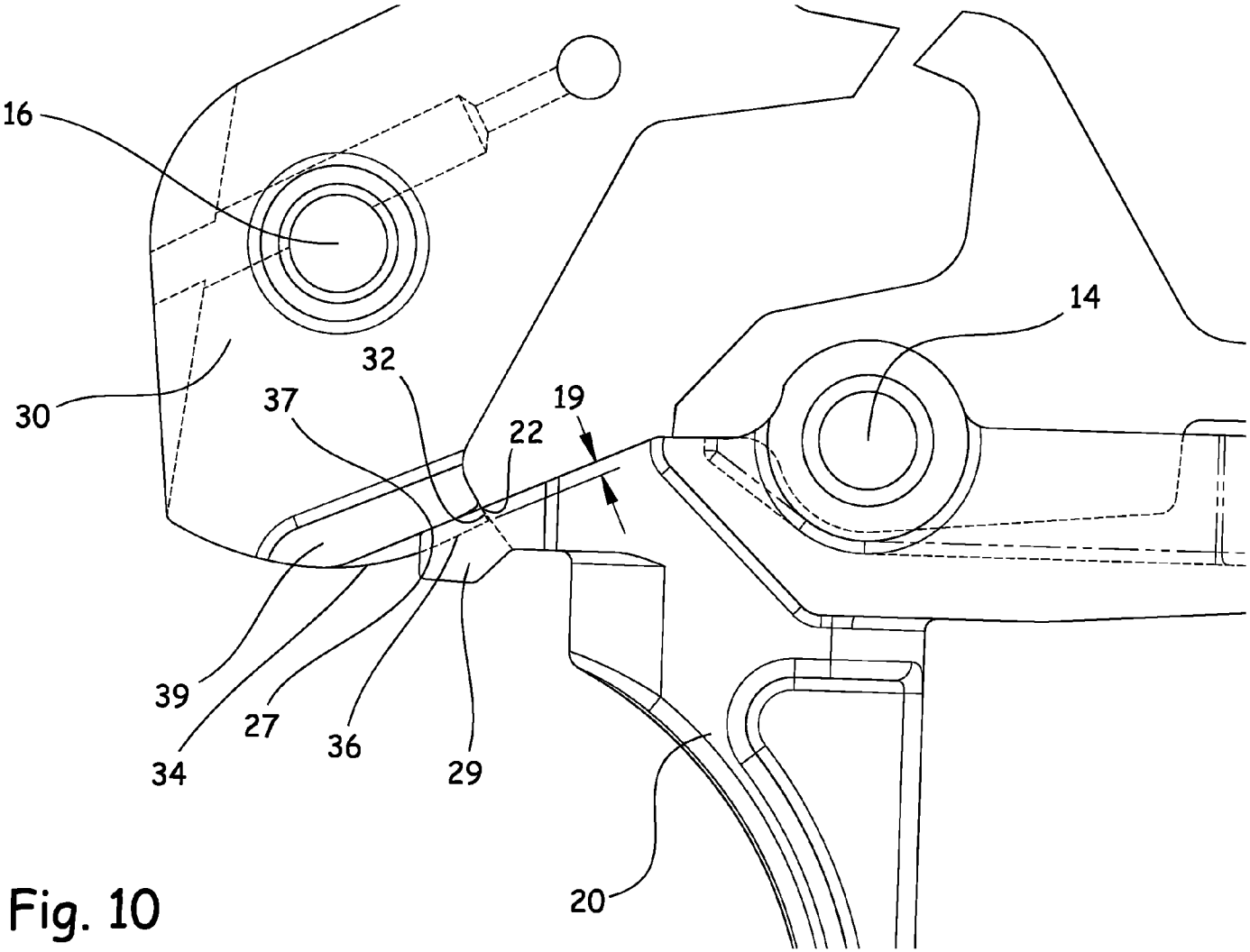
FIG. 10 shows a portion of FIG. 9 in greater detail.

FIG. 10 shows a portion of FIG. 9 in greater detail and illustrates the trigger sear 22, hammer sear 32 and cam surface 36 in hidden lines. Contact between the hammer sear 32 and trigger sear 22 is shown. Also, contact between the hammer secondary contact location 37 and the trigger secondary contact location 27 sets the rotational orientation of the hammer 30 and the trigger 20 in the first orientation, and arranges the hammer sear 32 and trigger sear 22 in a repeatable predetermined orientation. This repeatable predetermined orientation sets the amount of creep 19 between the first orientation and trigger break, or clearance of the sears 32, 22.

In some embodiments, a distance from the trigger axis 14 to the trigger secondary contact location 27 is greater than a distance from the trigger axis 14 to the trigger sear 22. In some embodiments, a trigger lobe 29 is located distal to the trigger sear 22 from the trigger axis 14. In some embodiments, the trigger sear 22 is located between the trigger axis 14 and the trigger secondary contact location 27.

In some embodiments, a distance from the hammer axis 16 to a closest portion of the cam surface 36 is greater than a distance from the hammer axis 16 to the hammer secondary contact location 37.

Figure 11:
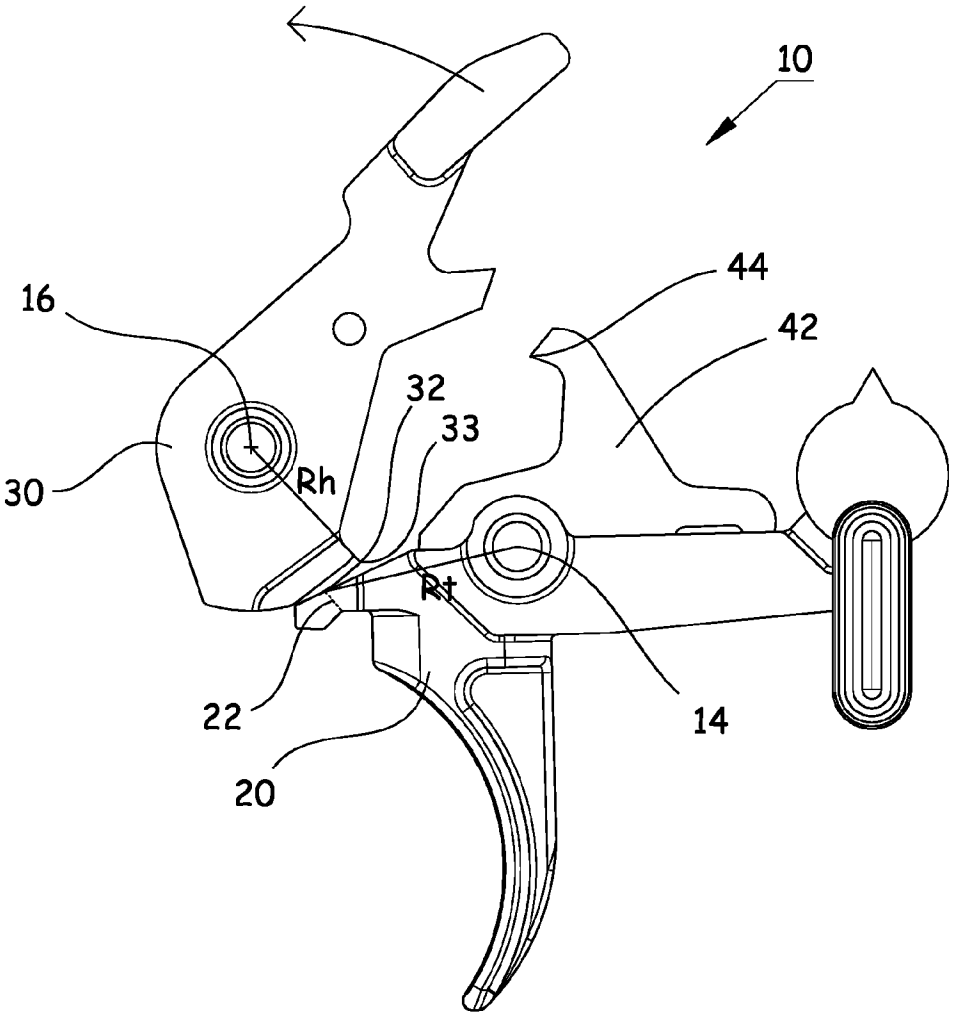
FIG. 11 shows the trigger group of FIG. 9 in a second orientation.
Figure 12:
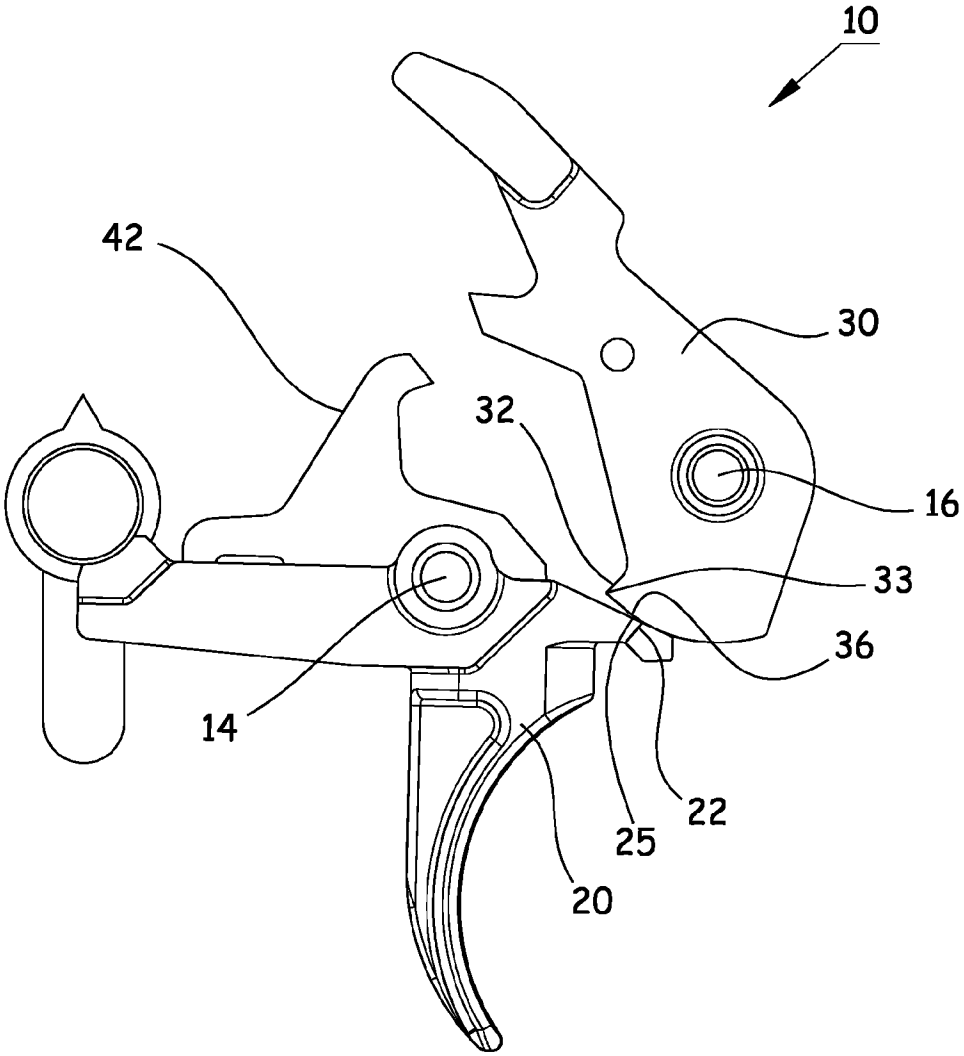
FIG. 12 shows the trigger group of FIG. 11 from a different viewing angle.

FIGS. 11 and 12 show the trigger group 10 of FIGS. 9 and 10 in a second orientation. FIG. 12 shows the trigger group 10 from the opposite direction of FIG. 11. The second orientation depicts the trigger group 10 after the trigger sear 22 has cleared the hammer sear 32 (after trigger break), while the hammer 30 is falling. The hammer secondary contact location 37 does not contact the trigger 20. The cam surface 36 of the hammer 30 is in contact with the following portion 25 of the trigger 20. In FIG. 12, contact between the cam surface 36 of the hammer 30 and the following portion 25 of the trigger 20 is visible.

In some embodiments, the trigger group 10 comprises a disconnector 42 (see e.g. FIGS. 4, 11 and 12). Desirably, a disconnector 42 is arranged to engage the hammer 30 as the hammer 30 is being reset subsequent to a firing sequence.

In some embodiments, a disconnector 42 is arranged to pivot about the trigger axis 14, and the disconnector 42 contacts the trigger 20. Desirably, as the hammer 30 falls and the cam surface 36 applies a force to the trigger 20 that rotates the trigger 20, the disconnector 42 is also rotated by the applied force. The rotation desirably moves a hammer engaging portion 44 of the disconnector 42 closer to the hammer 30.

FIG. 11 shows a hammer sear radius $R_h$ distance between the hammer axis 16 and a terminating portion of the hammer sear 32 (e.g. edge 33). A trigger sear radius $R_t$ distance is also shown between the trigger axis 14 and trigger sear 22. As shown in FIG. 11, a ratio of $R_t/R_h$ is approximately 1.3. In some embodiments, a trigger group 10 has a ratio of $R_t/R_h<2.5$. In some embodiments, a trigger group 10 has a ratio of $R_t/R_h<2.0$. In some embodiments, a trigger group 10 has a ratio of $R_t/R_h<1.5$. In some embodiments, a trigger group 10 has a ratio of $R_t/R_h<1.2$. In some embodiments, a trigger group 10 has a ratio of $R_t/R_h<1.0$.

In some embodiments, the trigger group 10 is sized to fit in an AR lower receiver, for example having the hammer axis 16 and trigger axis 14 at a predetermined separation and orientation with respect to one another.

In various embodiments, the trigger group 10 can be constructed and arranged for use with any suitable trigger-actuated device.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A trigger group comprising:

a trigger arranged to pivot on a trigger axis, said trigger comprising a trigger sear; and a hammer arranged to pivot on a hammer axis, said hammer comprising a hammer sear and a cam surface, said hammer sear and said cam surface sharing an edge, said cam surface defining a radial distance between said hammer axis and said cam surface, said radial distance increasing as said cam surface is traversed away from said hammer sear;

wherein said hammer is moveable from a first position to a second position upon break of said trigger, said hammer sear contacting said trigger sear in said first position, said cam surface contacting said trigger in said second position.

2. The trigger group of claim 1, said cam surface applying a force to said trigger in said second position.

3. The trigger group of claim 1, wherein said cam surface biases said trigger in a direction opposite a force provided by a trigger spring.

4. The trigger group of claim 1, said trigger comprising a following portion that contacts said cam surface in said second position.

5. The trigger group of claim 4, wherein said trigger sear and said following portion share an edge.

6. The trigger group of claim 1, said hammer comprising a secondary contact point in contact with said trigger in said first position, said secondary contact point setting a predetermined amount of trigger creep to break.

7. The trigger group of claim 6, wherein a plane oriented orthogonal to said hammer axis intersects said cam surface and said secondary contact point.

8. The trigger group of claim 6, wherein a plane oriented orthogonal to said hammer axis intersects said cam surface and does not intersect said secondary contact point.

9. The trigger group of claim 6, wherein said cam surface occupies a first width portion of said hammer, and said secondary contact point occupies a second width portion of said hammer.

10. The trigger group of claim 9, wherein said hammer sear is located in said first width portion.

11. The trigger group of claim 6, wherein said hammer comprises an extension lobe, said extension lobe comprising said secondary contact point.

12. The trigger group of claim 6, wherein said secondary contact point of said hammer contacts said trigger at a secondary contact location, the secondary contact location being farther away from the trigger axis than said trigger sear.

13. The trigger group of claim 1, said hammer defining a hammer sear radius $R_h$ distance from said hammer axis to said hammer sear, said trigger defining a trigger sear radius $R_t$ distance from said trigger axis to said trigger sear, wherein $R_t/R_h<2$.

14. The trigger group of claim 1, said cam surface having been formed by a process of machining wherein material was removed from said hammer.

15. A trigger group comprising:

a trigger arranged to pivot on a trigger axis, said trigger biased in a first rotational direction by a trigger spring, said trigger comprising a trigger sear and a following portion; and a hammer arranged to pivot on a hammer axis, said hammer biased in a second rotational direction by a hammer spring, said hammer comprising hammer sear and a cam surface adjacent to said hammer sear, said hammer sear and said cam surface sharing an edge, said cam surface defining a radial distance between said hammer axis and said cam surface, said radial distance increasing as said cam surface is traversed in the first rotational direction away from said hammer sear;

said hammer moveable from a first position wherein said trigger sear contacts said hammer sear to a second position wherein said cam surface contacts said following surface.

16. The trigger group of claim 15, wherein said cam surface biases said trigger in a direction opposite said first rotational direction.

17. The trigger group of claim 15, said following portion located adjacent said trigger sear.

18. The trigger group of claim 15, said hammer comprising a secondary contact point in contact with said trigger in said first position, said secondary contact point setting a predetermined amount of trigger creep to break.

* * * * *